US009502806B2

(12) United States Patent
Ewer et al.

(10) Patent No.: US 9,502,806 B2
(45) Date of Patent: Nov. 22, 2016

(54) TAMPER RESISTANT RECEPTACLE SHUTTER WITH FRICTION REDUCING LEAD IN CONFIGURATION

(71) Applicant: Hubbell Incorporated, Sheton, CT (US)

(72) Inventors: Stephen R. Ewer, Milford, CT (US); Scott B. Wurms, Shelton, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/743,517

(22) Filed: Jun. 18, 2015

(65) Prior Publication Data

US 2015/0372411 A1 Dec. 24, 2015

Related U.S. Application Data

(60) Provisional application No. 62/015,015, filed on Jun. 20, 2014.

(51) Int. Cl.
*H01R 13/453* (2006.01)

(52) U.S. Cl.
CPC ..... *H01R 13/4534* (2013.01)

(58) Field of Classification Search
CPC ..... H01R 13/447; H01R 13/453; H01R 13/4532; H01R 13/4534; H01R 13/4536; H01R 13/4538
USPC ..... 439/137–140
See application file for complete search history.

(56) References Cited

U.S. PATENT DOCUMENTS 4,379,607 A * 4/1983 Bowden, Jr. ..... H01R 13/4534 439/137
4,544,219 A * 10/1985 Barkas ..... H01R 13/4534 439/137
4,822,290 A * 4/1989 Cauley ..... H01R 13/4534 439/137
4,867,694 A * 9/1989 Short ..... H01R 13/4534 439/137
5,006,075 A * 4/1991 Bowden, Jr. ..... H01R 13/4534 439/137
5,020,997 A * 6/1991 Calderara ..... H01R 13/4534 439/137
5,915,981 A * 6/1999 Mehta ..... H01R 13/4534 439/137
6,056,564 A * 5/2000 Huang ..... H01R 13/4534 439/137
6,086,391 A * 7/2000 Chiu ..... H01R 13/4534 439/145
6,217,353 B1 * 4/2001 Yu-Tse ..... H01R 13/4534 174/67
6,238,224 B1 * 5/2001 Shao ..... H01R 13/4534 439/137
6,422,880 B1 * 7/2002 Chiu ..... H01R 13/4534 439/137
6,537,088 B2 * 3/2003 Huang ..... H01R 13/4534 439/137
6,537,089 B1 * 3/2003 Montague ..... H01R 13/4534 439/137
6,555,771 B2 * 4/2003 Shao ..... H01R 13/4534 200/51 R
6,776,630 B1 * 8/2004 Huang ..... H01R 13/4534 439/137
6,786,745 B1 * 9/2004 Huang ..... H01R 13/4534 439/137
6,893,275 B2 * 5/2005 Ng ..... H01R 13/4534 439/137
7,179,992 B1 * 2/2007 Packard ..... H01R 13/4536 174/53
7,455,538 B2 * 11/2008 Germain ..... H01R 13/4534 439/137
7,510,412 B1 * 3/2009 Valentin ..... H01R 13/4534 439/137
7,556,513 B2 * 7/2009 Ng ..... H01R 13/4534 439/137

(Continued)

*Primary Examiner* — Ross Gushi
(74) *Attorney, Agent, or Firm* — Michael Best & Friedrich, LLP

(57) ABSTRACT

A tamper resistant receptacle having cooperating shutter mechanisms wherein each shutter member has a lead-in cam surface having a steep initial point of contact and a flatter sliding surface (tangent fillets) to provide both an advantageous point of contact while also providing sufficient lateral clearance to un-shutter a blade opening, or lead-in cam surface having a continuously convex radius thereby providing a curved surface for the entire length of the camming operation, or a lead-in surface comprising a roller disposed in a fillet of a slide block cam surface.

2 Claims, 7 Drawing Sheets

(56) References Cited

U.S. PATENT DOCUMENTS 7,588,447 B1 * 9/2009 Ni ..... H01R 13/4534 439/137
7,637,756 B1 * 12/2009 Hsu ..... H01R 13/4534 439/137
7,645,148 B2 * 1/2010 Carbone ..... H01R 13/4534 439/137
7,645,149 B2 * 1/2010 Carbone ..... H01R 13/4534 439/137
7,651,347 B2 * 1/2010 Germain ..... H01R 13/4534 439/137
7,651,348 B2 * 1/2010 Huang ..... H01R 13/4534 439/137
7,695,293 B1 * 4/2010 Sikes ..... H01R 13/4532 439/139
7,820,909 B2 * 10/2010 Castaldo ..... H01R 13/4534 174/53
7,833,030 B1 * 11/2010 Huang ..... H01R 13/4534 439/137
7,859,368 B2 * 12/2010 Huang ..... H01H 83/04 335/18
7,883,346 B2 * 2/2011 Huang ..... H01R 13/4534 439/140
7,887,346 B1 * 2/2011 Huang ..... H01R 13/4534 439/140
7,914,307 B1 * 3/2011 Yang ..... H01R 13/4534 439/137
7,934,935 B1 * 5/2011 Gao ..... H01R 13/4534 439/137
7,938,676 B1 * 5/2011 Patel ..... H01Q 1/2233 439/137
7,942,681 B2 * 5/2011 Ni ..... H01R 13/4534 439/137
7,985,085 B2 * 7/2011 Gao ..... H01R 13/4534 439/137
8,007,296 B2 * 8/2011 Chen ..... H01R 13/4534 439/136
8,044,299 B2 * 10/2011 Weeks ..... H01R 13/4534 174/53
8,100,705 B2 * 1/2012 Chen ..... H01R 13/4534 439/137
8,147,260 B2 * 4/2012 Huang ..... H01R 13/4534 439/140
8,187,011 B1 * 5/2012 Baldwin ..... H01R 13/4534 439/137
8,187,012 B1 * 5/2012 Baldwin ..... H01R 13/4534 439/137
8,193,445 B2 * 6/2012 Li ..... H01R 13/4534 174/50
8,242,362 B2 * 8/2012 Castaldo ..... H01R 13/4534 174/53
8,297,990 B2 * 10/2012 Huang ..... H02H 3/16 439/140
8,366,463 B2 * 2/2013 Zhang ..... H01R 13/4534 439/135
8,382,497 B2 * 2/2013 Huang ..... H01R 13/4534 439/137
8,491,319 B1 * 7/2013 Baldwin ..... H01R 13/4534 439/137
8,550,829 B2 * 10/2013 Huang ..... H01R 13/4534 439/127
8,562,362 B2 * 10/2013 Jiang ..... H01R 13/4534 439/137
8,568,152 B1 * 10/2013 Weeks ..... H05K 5/02 439/137
8,632,347 B2 * 1/2014 Chen ..... H01R 13/453 439/137
8,632,348 B2 * 1/2014 Baldwin ..... H01R 13/4534 439/138
8,672,695 B2 * 3/2014 Baldwin ..... H01R 13/4534 439/137
8,808,013 B2 * 8/2014 Baldwin ..... H01R 13/4534 439/139
8,834,186 B2 * 9/2014 Lo ..... H01R 13/4534 439/140
8,858,245 B2 * 10/2014 Huang ..... H01R 13/4534 439/137
8,888,514 B2 * 11/2014 Baldwin ..... H01R 13/4534 439/137
9,048,559 B2 * 6/2015 Huang ..... H01R 13/4534
9,059,529 B1 * 6/2015 Lai ..... H01R 13/44
9,059,530 B2 * 6/2015 Byrne ..... H01R 13/4534
9,196,995 B2 * 11/2015 Scanzillo ..... H01R 13/453
2009/0186500 A1 * 7/2009 Benoit ..... H01R 13/4534 439/93
2009/0311892 A1 * 12/2009 Weeks ..... H01R 13/4534 439/137
2010/0041259 A1 * 2/2010 Ni ..... H01R 13/4534 439/137
2010/0159722 A1 * 6/2010 Chen ..... H01R 13/4534 439/137
2011/0136358 A1 * 6/2011 Zhang ..... H01R 13/4534 439/135
2011/0263145 A1 * 10/2011 Kim ..... H01R 13/4534 439/137
2012/0083143 A1 * 4/2012 Jiang ..... H01R 13/4534 439/137
2012/0149221 A1 * 6/2012 Huang ..... H01R 13/4534 439/137
2013/0295788 A1 * 11/2013 Baldwin ..... H01R 13/4534 439/137
2014/0030898 A1 * 1/2014 Baldwin ..... H01R 13/4534 439/140
2015/0064944 A1 * 3/2015 Scanzillo ..... H01R 13/4534 439/137
2015/0372411 A1 * 12/2015 Ewer ..... H01R 13/4534 439/138
2015/0372412 A1 * 12/2015 Samojeden ..... H01R 13/4536 439/138
2015/0380856 A1 * 12/2015 Mortun ..... H01R 13/4534 439/138
2016/0013577 A1 * 1/2016 Diakomis ..... H01R 13/4536 439/138

* cited by examiner

TAMPER RESISTANT RECEPTACLE SHUTTER WITH FRICTION REDUCING LEAD IN CONFIGURATION

CROSS-REFERENCE TO RELATED APPLICATIONS

The present application claims priority under 35 U.S.C. 102(e) to U.S. Provisional Application 62/015,015, filed Jun. 20, 2014, the contents of which are hereby incorporated by reference in their entirety.

FIELD OF THE INVENTION

The present invention relates to tamper resistant electrical receptacles. More particularly, the present invention relates to tamper resistant electrical receptacles using laterally sliding shutters spring biased to block access to the device's electrical contacts.

BACKGROUND OF THE INVENTION

Tamper resistant receptacles are known in the art. "Tamper Resistant" or "TR" receptacles are a class of electrical receptacle outlets configured to deny access to the device's electrical contacts unless force is applied simultaneously to both the hot and neutral plug openings of the device pursuant to NEC Code 406.11 et seq. The Code and related regulatory requirements provide that not only must the outlet openings remain blocked unless force is applied to both openings at the same time, but also that any foreign object 1/32 inch or larger, must be prevented from bypassing the blocking member of a plug opening.

As will be appreciated, these requirements were enacted in response to the phenomena of small children curiously inserting a small toy or metal object into the hot or neutral opening of a receptacle and suffering electrical shock, burns, or even death.

In meeting the standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. No. 7,645,148 to Carbone et al.; and U.S. Publ. No. 2013/0295788 to Baldwin, et al. and the references cited therein, the entire contents of which are hereby incorporated by reference in their entirety.

The proliferation of these important safety devices has led to an appreciation of the issues affecting their effective life span. A presently appreciated issue recognized by the present inventors stems from the sharpness of plug blades being found on electrical products imported from overseas. As will be appreciated, during insertion of the plug blades into the outlet face openings, the vertical force of the incoming blades has the same point of contact on the cam surface. The cam surface of most prior art devices is an inclined "ramp" of about 45° that is of a length sufficient to cause lateral displacement during insertion of a distance that is equal to the entire distance necessary to un-shutter a blade opening (typically about 1.8 mm). Over time, these sharp blades having a single point of initial contact begin to deform and cut into the ramp surface which makes movement more difficult as the blades get stuck in gouges or scratches at the point of contact. With each successive insertion, more and more force is needed to friction force the camming action and concomitant lateral sliding of the shutters. At some point, the deformity of the ramp surface may make insertion of a plug excessively difficult or even impossible. As this point, the device has reached the end of its useful life.

The foregoing underscores some of the problems associated with conventional TR receptacles. Furthermore, the foregoing highlights the long-felt, yet unresolved need in the art for a TR receptacle that may extend the useful life of the device. Moreover, the forgoing highlights the long-felt, yet unresolved need in the art for a TR receptacle that has an extended service life at a reasonable cost.

SUMMARY OF THE INVENTION

Various embodiments of the present invention overcome various of the aforementioned and other disadvantages associated with prior art TR receptacles and offers new advantages as well. Although not wishing to be bound by theory, the present inventors' recognize that altering the camming surface of the lead frame of the shutter mechanism to a more frictionally advantageous configuration may extend the service life of some prior art TR receptacles.

According to one aspect of various embodiments of the present invention there is provided a TR receptacle having cooperating shutter mechanisms wherein each shutter member has a lead-in cam surface having a steep initial point of contact and a flatter sliding surface (tangent fillets) to provide both an advantageous point of contact while also providing sufficient lateral clearance to un-shutter a blade opening.

According to another aspect of various embodiments of the present invention, there is provided a TR receptacle having cooperating shutter mechanisms wherein each shutter member has a lead-in cam surface having a continuously convex radius thereby providing a curved surface for the entire length of the camming operation.

According to yet another aspect of various embodiments of the present invention, there is provided a TR receptacle having cooperating shutter mechanisms wherein each shutter member has a lead-in surface comprising a roller disposed in a fillet of a slide block cam surface.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein.

DETAILED DESCRIPTION OF A PREFERRED EMBODIMENT

While the present invention will be described in connection with a TR receptacle of the type having cooperating shutters generally described above, it will be readily apparent to one of ordinary skill in the art armed with the present specification that the present invention can be applied to a multiplicity of fields and uses. In particular, the present invention may find use in connection with other types of TR receptacles where reduction in point of impact is desirable. Finally, one of ordinary skill in the art armed with the present specification will also understand that the present system may be easily modified to include different configurations, mechanisms, methods, and kits, which achieve some or all of the purposes of the present invention.

Figure 1:
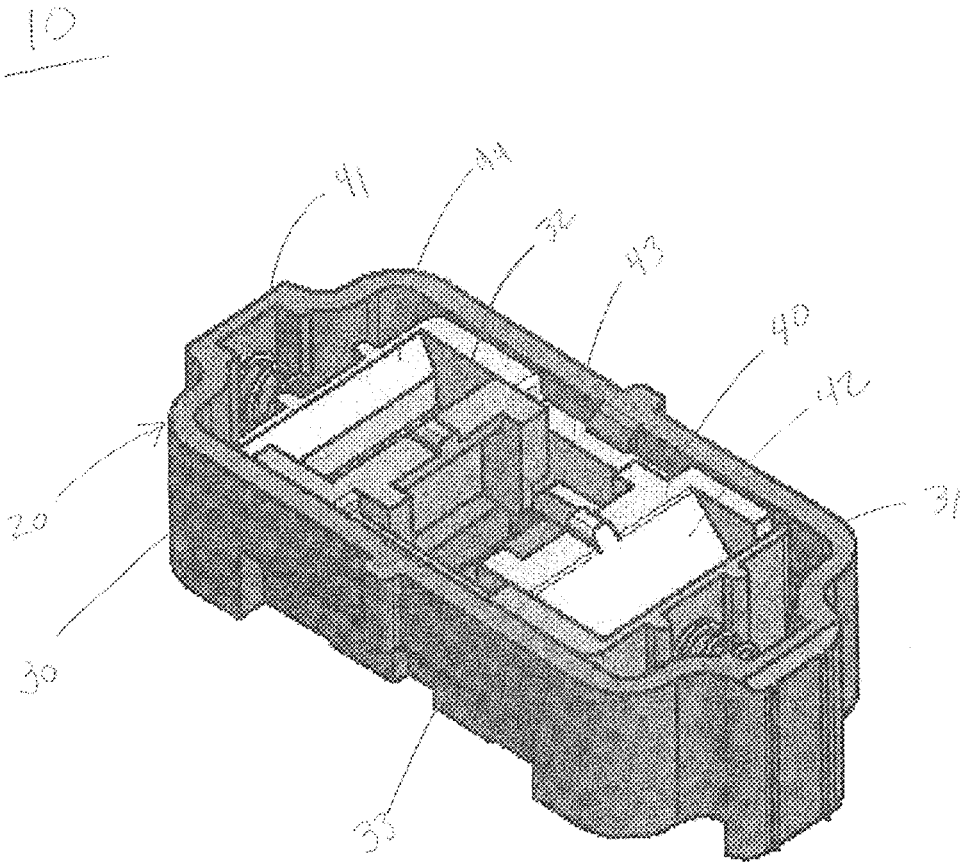
FIG. 1 PRIOR ART
FIG. 1 is a top perspective view of a shutter assembly of a TR receptacle according to an exemplary embodiment of the invention.
Figure 2:
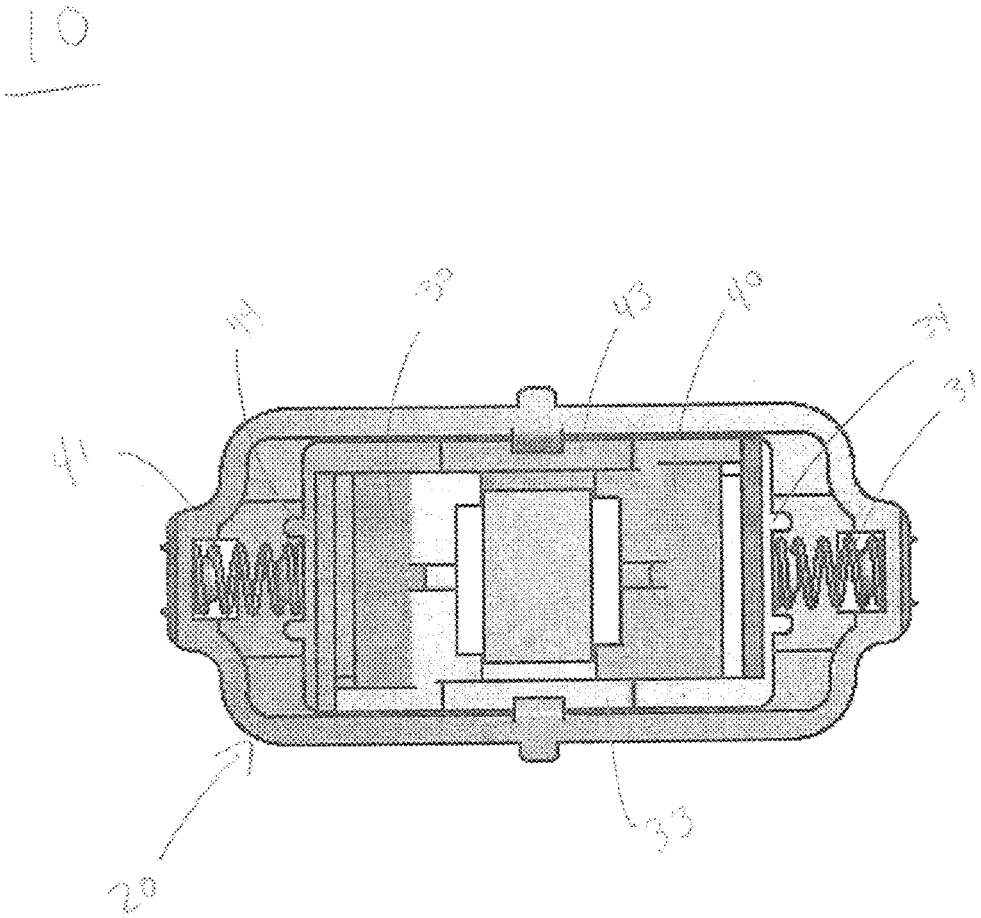
FIG. 2 PRIOR ART
FIG. 2 is a top view of the shutter assembly of FIG. 1 with the shutters in the "closed" position.
Figure 3:
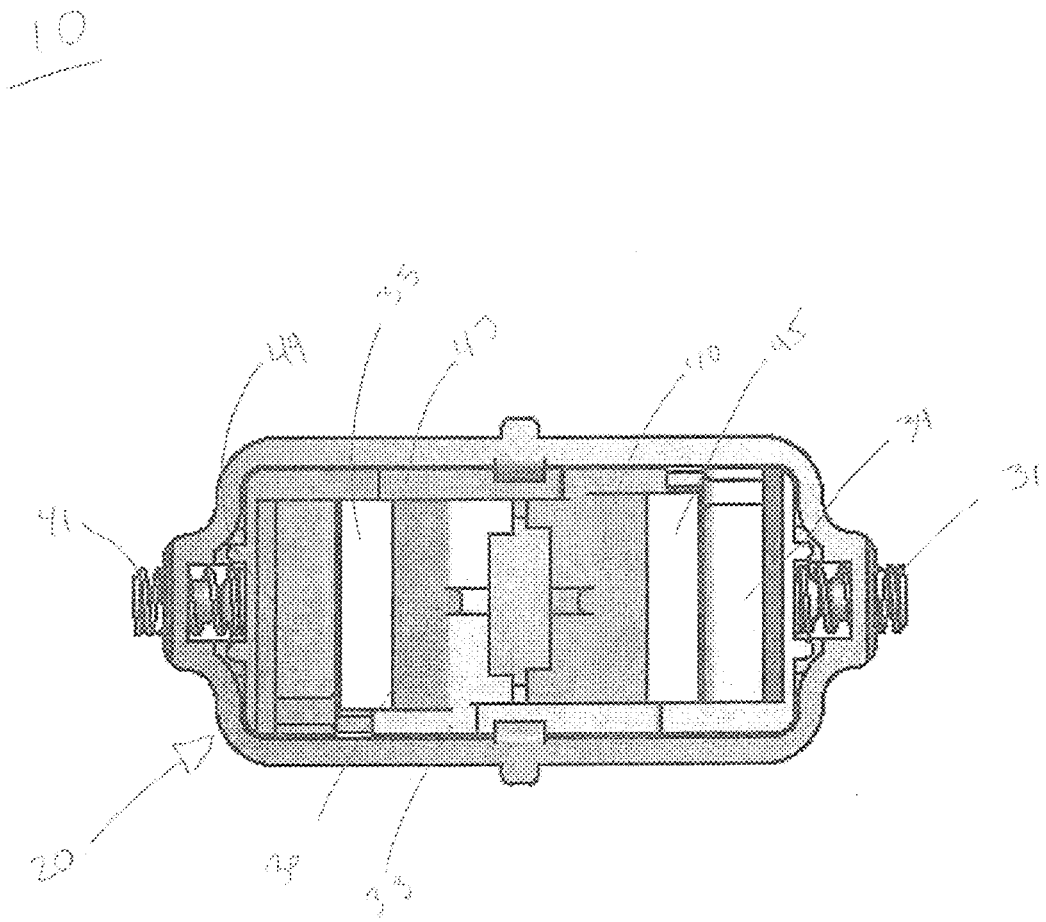
FIG. 3 PRIOR ART
FIG. 3 is a top view of the shutter assembly of FIG. 1 with the shutters in the "open" position.

Turning to the Figures, a commonly used shutter assembly for a TR receptacle is depicted generically in FIGS. 1-3. As depicted, the assembly 10 is positioned below the face plate of an electrical receptacle (not shown). The assembly 10 comprises a shutter housing 20 encircling a hot blade shutter 30 and a neutral blade shutter 40. Each of the shutters 30, 40 is associated with a respective spring member 31, 41 that bias's its shutter in the closed position as best discerned from a comparison of FIG. 2 (closed position) and FIG. 3 (open position).

As shown, the shutters 30, 40 each include a cam portion 32, 42 spring-biased directly beneath the associated hot or neutral blade opening of the faceplate assembly. The shutters 30, 40 also include lateral arms 33, 43 extending away from the cam portions 32, 42 and terminating in respective blocking portions 34, 44. The blocking portion 34 of the hot blade shutter 30 blocks access to the neutral blade's electrical contact of the receptacle, and the neutral blade blocking portion 44 blocks access to the hot blade's electrical contact of the receptacle.

In the generic embodiment shown in FIGS. 1-3, the springs 31, 41 are positioned abutting the blocking portions 34, 44 of the shutters 30, 40 such that simultaneous insertion of plug blades into the hot and neutral blade openings 35, 45 allows each cam portion 32, 42 to move laterally as the respective plug blade contacts and pushes against the cam surface overcoming the spring bias of the spring as the blocking portions move laterally. The plug blades continue to cam past cam portions 32, 42 until they reach the electrical contact disposed beneath. As will be appreciated, the only way a plug blade can continue its vertical path towards the electrical contact underneath is if the blocking portion of the shutter of the opposite blade opening is moved out of the way. Accordingly, if only one blade tine (or a child's toy, etc.) is inserted into either the hot or neutral opening in the faceplate, the cam portion will only move enough to allow the tine to run into the blocking portion of the other shutter since each shutter operates independently of the other. There is no way to reach the electrical contact. It is only through simultaneous insertion that the shutters cooperatively (but independently) move incrementally such that as each blade cams along the camming surface and gradually pushes the blocking portion out of the way of the other blade opening to allow both blades to be inserted further and further until the openings are fully opened, the springs compressed, and the blades cammed past the shutters allowing the blades to plug in to the receptacle's electrical face contacts.

Figure 4:
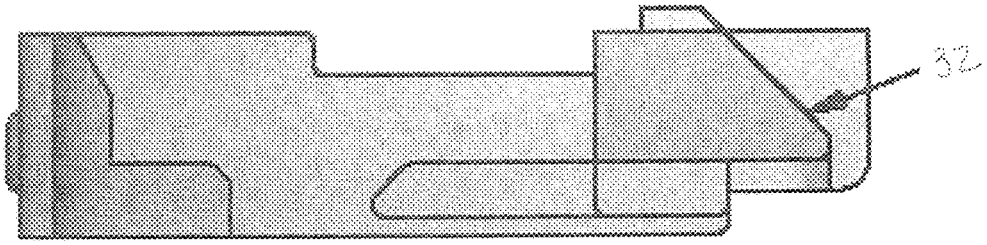
FIG. 4 PRIOR ART
FIG. 4 is a side view in partial cross-section of the shutter assembly of FIG. 1 showing a blade-receiving cam portion of a shutter member.

As shown in FIG. 4, the operational surface of the camming portions 32, 42 of prior art TR receptacles is a 45° sloping surface. The slope provides a surface that can translate vertical force into lateral motion while also providing a sufficient length for the lateral displacement of the blocking portion to be enough to clear the plug openings of the outlet's faceplate. As will be appreciated, if the slope is too steep, the blades camming past will not provide enough lateral displacement to uncover the outlet opening; conversely, if the slope is too flat, the blades may just press down on the cam surface and not move the shutter laterally against its spring.

In any event, as will be appreciated, with the 45° sloping surface of existing devices, each time the blade of a plug is inserted into a receptacle, the blade will have the identical point of contact. The vertical force of the blade necessary to force lateral movement of the shutter by overcoming the spring bias of the shutter may be enough to scratch or bend the surface. With subsequent insertions, the plug blades can exacerbate cuts or bends in the surface resulting in more and more force being necessary to move the shutter. Over time, the deformation of the surface may reach a point that either so much force is necessary to slide past the point of contact, or the deformation is to a point that the shutter is unable to slide such that the device reaches the end of it useful life.

Figure 5:
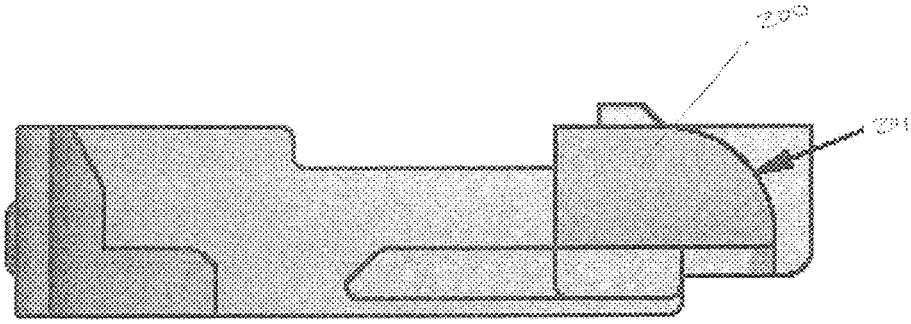
FIG. 5 depicts a side view in partial cross-section of the shutter assembly of FIG. 1 showing a modified blade-receiving cam portion according to a preferred embodiment of the invention.

The present inventors, recognizing that this phenomena may be exacerbated by plug blades from overseas countries that are sharper than those traditionally found on domestic products, conceived of a low-cost modification that may increase the useful life of TR receptacles. In sum, the inventors altered the profile of the camming surface to reduce the frictionally force and point of impact damage. A first presently preferred embodiment of the invention utilizes a continuous radius operating surface as shown in FIG. 5. As depicted, the camming surface 200 is convexly-curved radius. With this configuration, a blade of a plug will strike the surface on a curve 201 which provides more favorable friction and impact features to facilitate lateral movement of the shutter and reduce damage to the camming surface 200.

Figure 6:
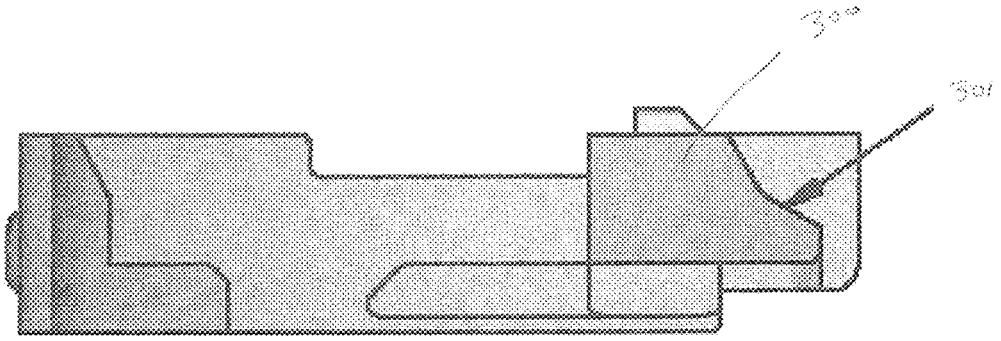
FIG. 6 depicts a side view in partial cross-section of the shutter assembly of FIG. 1 showing an alternative blade-receiving cam portion according to a preferred embodiment of the invention.

Another alternative embodiment of the present invention providing favorable friction and impact features is depicted in FIG. 6. As shown, the camming surface 300 is configured as a concave fillet having a steep initial portion 301 curving into a flatter end portion 302. With this configuration, the frictional advantages of a steep slope (less frictional resistance) are combined with the frictional advantages of a curved surface (so the blade does not get caught or dig into a seam), and a suitable length (to ensure clearance of the plug opening).

Figure 7:
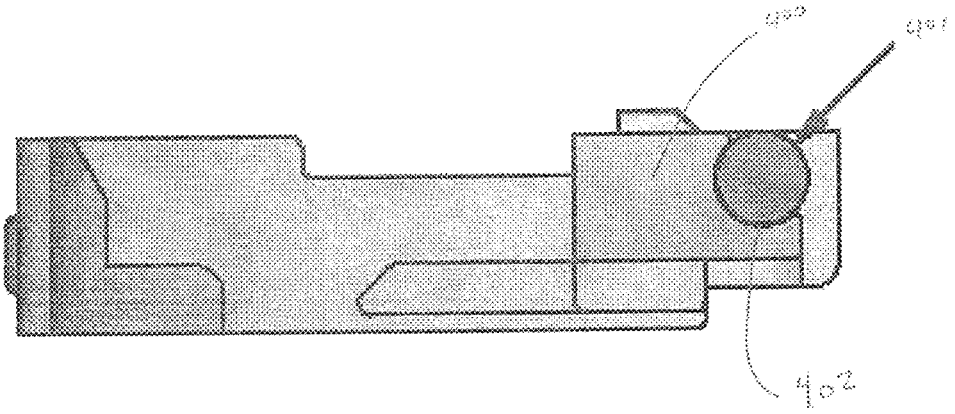
FIG. 7 depicts a side view in partial cross-section of the shutter assembly of FIG. 1 showing a two-piece alternative blade-receiving cam portion according to a preferred embodiment of the invention.

Yet another alternative embodiment of the present invention providing favorable friction and impact features is depicted in FIG. 7. As shown, the camming surface 400 includes a roller 401 seated in a fillet 402 of the cam body. The roller provides the advantages of a continuously curved surface and point of contact.

The frictional advantages of the present embodiments (and related embodiments) will be appreciated by one of ordinary skill in the art armed with the present specification realizing that a force vector F incident on a point P of surface S can be expressed as the vector sum of a normal force vector FN and a parallel force vector Fp, where FN is directed toward and perpendicular to S at P, and Fp is directed along S (if S is flat) or along a tangent of S at P (if S is curved). For a given force magnitude F, adjusting the angle of F will increase or decrease the magnitudes of its normal and parallel force vector components, such that F2=FN2+Fp2. If an angle $\phi$ is the angle between F and a line normal to S at P, increasing $\phi$ will decrease FN and increase Fp, while decreasing $\phi$ will increase FN and decrease Fp. (Note that $\phi$ is not the angle between F and a line along the surface S, but rather the angle between F and a line normal to the surface S at point P)

Absent other forces, a frictional force f due to F is a force directed along S (if S is flat) or along a tangent of S at P (if S is curved), and directed in a direction opposite Fp. Its magnitude can be computed using the formula $f=FN\cdot\mu$, where $\mu$ is a coefficient of friction. Consequently, f is directly proportional to FN, such that increasing $\phi$ will decrease f, while decreasing $\phi$ will increase f. Therefore, F will have less resistance by friction and a greater Fp component as $\phi$ approaches 90°.

One of ordinary skill in the art will appreciate that the coefficient of friction between certain materials may vary based on speed, and that different materials may deform or wear differently based on the angle of attack. Routine experimentation by the ordinarily skilled artisan is all that is needed to select suitable materials and a suitable design to achieve optimal results.

Accordingly, one of ordinary skill will appreciate that the exact dimensions and materials are not critical to the invention and all suitable variations should be deemed to be within the scope of the invention if deemed suitable for carrying out the objects of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters to adjust for carrying out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

What is claimed is:

1. A tamper resistant receptacle comprising:

a housing defining at least one plug receptacle area comprising a hot blade opening and a neutral blade opening;

a pair of cooperating shutters members disposed under a respective one of said blade openings, said shutters having cooperating shutter mechanisms wherein each shutter member has a lead-in cam surface having a concave radius thereby providing a curved surface for the entire length of the camming operation and providing sufficient lateral clearance to un-shutter said blade openings.

2. A tamper resistant receptacle comprising: a housing defining at least one plug receptacle area comprising a hot blade opening and a neutral blade opening:

a pair of cooperating shutters members disposed under a respective one of said blade openings, said shutters having cooperating shutter mechanisms; and wherein each shutter member wherein each shutter member has a lead-in surface comprising a roller disposed in a fillet of a cam body.

* * * * *